US008920181B2

(12) United States Patent
Hida et al.

(10) Patent No.: US 8,920,181 B2
(45) Date of Patent: Dec. 30, 2014

(54) COAXIAL CONNECTOR

(71) Applicant: Hirose Electric Co., Ltd., Tokyo (JP)

(72) Inventors: Kohei Hida, Tokyo (JP); Tsuyoshi Nakagawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 41 days.

(21) Appl. No.: 13/891,263

(22) Filed: May 10, 2013

(65) Prior Publication Data

US 2013/0303008 A1 Nov. 14, 2013

(30) Foreign Application Priority Data

May 11, 2012 (JP) ..... 2012-109173

(51) Int. Cl.
*H01R 29/00* (2006.01)
*H01R 13/703* (2006.01)
*H01R 24/46* (2011.01)

(52) U.S. Cl.
CPC ..... *H01R 13/703* (2013.01); *H01R 24/46* (2013.01)
USPC ..... 439/188; 439/63

(58) Field of Classification Search
CPC ..... H01R 2103/00; H01R 13/7032; H01R 24/46; H01R 12/7094
USPC ..... 439/188, 63, 581
See application file for complete search history.

(56) References Cited

U.S. PATENT DOCUMENTS

| | | | | |
|---|---|---|---|---|
| 6,761,571 | B2 * | 7/2004 | Hida | 439/188 |
| 7,632,123 | B2 * | 12/2009 | Nakagawa | 439/188 |
| 7,891,979 | B2 * | 2/2011 | Chien et al. | 439/63 |
| 8,038,450 | B2 * | 10/2011 | Nakagawa | 439/63 |
| 8,113,857 | B1 * | 2/2012 | Huang | 439/188 |
| 8,535,074 | B2 * | 9/2013 | Hirakawa et al. | 439/188 |
| 8,727,798 | B2 * | 5/2014 | Huo et al. | 439/188 |

FOREIGN PATENT DOCUMENTS

| | | |
|---|---|---|
| JP | 2007-141665 A | 6/2007 |
| JP | 2008-226588 A | 9/2008 |

* cited by examiner

*Primary Examiner* — Xuong Chung Trans
(74) *Attorney, Agent, or Firm* — Kubotera & Associates, LLC

(57) ABSTRACT

A coaxial connector includes an insulation housing having a receptacle opening portion for receiving a coaxial plug; an outer conductive member; a first terminal disposed below the receptacle opening portion; a second terminal disposed below the first terminal; and an insulation member disposed between the first terminal and the second terminal. The first terminal includes a first contact portion for contacting with a central conductive member of the coaxial plug. The second terminal includes a second contact portion for contacting with the central conductive member. The first terminal further includes a third contact portion, and the second terminal further includes a fourth contact portion for contacting with the third contact portion when the coaxial plug is not inserted into the insulation housing.

8 Claims, 11 Drawing Sheets

COAXIAL CONNECTOR

BACKGROUND OF THE INVENTION AND RELATED ART STATEMENT

The present invention relates to a coaxial connector to be mounted on a substrate. In particular, the present invention relates to a coaxial connector with a switch including a switching mechanism for switching a high-frequency signal circuit, an antenna, and the like.

In portable information communication devices such as cellular phones, a conventional coaxial connector with a switch has been widely used for inspection of a built-in high-frequency circuit thereof. The conventional coaxial connector with a switch includes, for example, an insulation housing having a hole that can receive a central conductive member of a coaxial plug; an outer conductive member provided outside the insulation housing; and a stationary terminal and a movable terminal provided under the hole. Furthermore, the stationary terminal includes a contact section, and the movable terminal includes a securing section to be secured on the insulation housing. Further, the movable terminal includes an elastic section that can contact with the central conductive member of the coaxial plug and abut against the contact section (for example, refer to Patent Reference 1).

Patent Reference 1: Japanese Patent Publication No. 2007-141665

In the conventional coaxial connector with a switch disclosed in Patent Reference 1, when the coaxial plug is not attached thereto, the movable terminal is pressed onto the contact section of the stationary terminal by an elastic force of the elastic section, so that the stationary terminal and the movable terminal keep the electrically connected state.

On the other hand, when the coaxial plug is attached thereto, a lower end of the central conductive member of the coaxial plug passes through the vertical hole of the conventional coaxial connector. In this state, the central conductive member touches the elastic section, and the elastic section is pressed down by the central conductive member, so that the elastic section is elastically deformed and moved away from the contact section. Accordingly, the stationary terminal and the movable terminal are electrically disconnected from each other, and at the same time, the central conductive member and the movable terminal become the connected state. As such, in turn, signals, which flew from the movable terminal to the stationary terminal, are made flow from the movable terminal to the central conductive member, and thereby it is possible to inspect a high-frequency circuit connected to the movable terminal.

In these years, because of increasing demands including downsizing of portable information communication devices, there have been necessities to improve not only internal circuits such as high-frequency circuits and central processing circuits, but also downsizing of parts to be mounted thereon such as antennas or a mounting technology thereof. For this reason, it is necessary to conduct measurement or inspection of a high-frequency circuit, an antenna, and the like while they are being switched. In the conventional coaxial connector with a switch, when the integrated circuit, the electronic component, and the like are inspected after mounting the integrated circuit, the electronic component, and the like, for example, it is possible to connect only to the high-frequency circuit to conduct the inspection thereof after temporarily disconnecting the antenna from the high-frequency circuit. However, it is difficult to connect only to the antenna and conduct the inspection thereof after temporarily disconnecting the high-frequency circuit from the antenna.

For this reason, it is necessary to develop a coaxial connector with a switch, whereby it is possible to switch a plurality of terminals. Patent Reference 2 has disclosed a conventional coaxial connector with a switch capable of measuring characteristics of both the high-frequency circuit and the antenna.

Patent Reference 2: Japanese Patent Publication No. 2008-226588

In the conventional coaxial connector with a switch described in Patent Reference 2, the coaxial plug includes a resin protrusion. When the coaxial plug is connected to the conventional coaxial connector, the resin protrusion touches and presses down a first switch spring of a receptacle to block electrical connection with the first switch spring while maintaining electrical connection with a second switch spring. Alternatively, the resin protrusion touches and presses down the second switch spring of the receptacle to block electrical connection with the second switch spring, while maintaining electrical connection with the first switch spring. Accordingly, it is possible to switch the electrical connection by changing the position of the resin protrusion of the coaxial plug.

However, the conventional coaxial connector with a switch described in Patent Reference 2 tends to have a complicated coaxial connector structure, thereby deteriorating production efficiency and increasing a size thereof. In addition, the coaxial plug is connected only in a fixed direction, thereby making it difficult to use.

In view of the problems described above, an object of the present invention is to provide a coaxial connector with a switch capable of solving the problems of the conventional coaxial connector. In the present invention, it is possible to switch a plurality of terminals while maintaining high productivity, a low cost, and easy operation.

Further objects and advantages of the invention will be apparent from the following description of the invention.

SUMMARY OF THE INVENTION

In order to attain the objects described above, according to a first aspect of the present invention, a coaxial connector with a switch is to be mounted on a substrate. The coaxial connector includes an insulation housing that has a hole that can receive central conductive members of a first coaxial plug and a second coaxial plug from above; an outer conductive member that is provided outside the insulation housing so that outer conductive members of the first coaxial plug and second coaxial plug can be attached to or detached from the outer conductive member; a first terminal provided under the hole; a second terminal that is provided under the hole and also under the first terminal and is capable of elastically displacing downward when the second terminal receives the central conductive member of the first coaxial plug or the second coaxial plug; and an insulation member provided between the first terminal and the second terminal.

According to the first aspect of the present invention, an end section of the central conductive member of the first coaxial plug includes an outer extending section, which is larger in the diametric direction than an end section of the central conductive member of the second coaxial plug. The first terminal has a first contact section on an upper surface thereof that contacts with the outer extending section of the central conductive member of the first coaxial plug when the central conductive member of the first coaxial plug is fitted in the hole of the insulation housing. Further, the second terminal has a second contact section on an upper surface thereof that contacts with the central conductive member of the second coaxial plug when the central conductive member of the second coaxial plug is fitted in the hole of the insulation housing.

According to the first aspect of the present invention, the first terminal has a third contact section on a lower surface thereof that contacts with a fourth contact section of the second terminal, when any of the central conductive members of the first coaxial plug and the second coaxial plug is fitted in the hole of the insulation housing. Further, the second terminal has the fourth contact section on an upper surface thereof that contacts with the third contact section of the first terminal, when any of the central conductive members of the first coaxial plug and second coaxial plug is not fitted in the hole of the insulation housing.

According to the first aspect of the present invention, when any of the central conductive members of the first and second center coaxial plug is not fitted in the hole of the insulation housing, the third contact section and the fourth contact section contact with each other, so that the first terminal and the second terminal are electrically connected to each other. When the central conductive member of the first coaxial plug is fitted in the hole of the insulation housing, the outer extending section of the central conductive member of the first coaxial plug touches the first contact section, so that the second terminal is pressed down by the insulation member. Accordingly, the fourth contact section is moved away from the third contact section, so that the first terminal and the second terminal are electrically disconnected from each other, and the central conductive member of the first coaxial plug and the first terminal are electrically connected to each other.

According to the first aspect of the present invention, when the second central conductive member of the coaxial plug is fitted in the hole of the insulation housing, the central conductive member of the second coaxial plug touches the second contact section, so that the second terminal is pressed down by the central conductive member of the second coaxial plug. Accordingly, the fourth contact section is moved away from the third contact section, so that the first terminal and the second terminal are electrically disconnected, and the central conductive member of the second coaxial plug and the second terminal are electrically connected to each other.

According to a second aspect of the present invention, a coaxial connector with a switch is to be mounted on a substrate. The coaxial connector includes an insulation housing that has a hole that can receive the central conductive members of the first coaxial plug and second coaxial plug from above; an outer conductive member that is provided outside the insulation housing so that the outer conductive members of the first coaxial plug and the second coaxial plug are attached to or detached from the outer conductive member; a first terminal that is provided under the hole and is capable of elastically displacing when the first terminal receives the central conductive member of the first coaxial plug or the second coaxial plug; and a second terminal that is provided under the hole and also under the first terminal and that is capable of elastically displacing when the second terminal receives the central conductive member of the first coaxial plug or the second coaxial plug.

According to the second aspect of the present invention, an end section of the central conductive member of the first coaxial plug has an insulation member and an outer extending section that is larger than the central conductive member of the second coaxial plug in the diametric direction. Further, the first terminal has a first contact section on an upper surface thereof that contacts with the outer extending section of the central conductive member of the first coaxial plug, when the central conductive member of the first coaxial plug is fitted in the hole of the insulation housing. Further, the second terminal has a second contact section on an upper surface thereof that contacts with the central conductive member of the second coaxial plug when the central conductive member of the second coaxial plug is fitted in the hole of the insulation housing.

According to the second aspect of the present invention, the first terminal has a third contact section on a lower surface thereof that contacts with a fourth contact section of the second terminal, when any of the central conductive members of the first coaxial plug and the second coaxial plug is not fitted in the hole of the insulation housing. Further, the second terminal has the fourth contact section on an upper surface thereof that contacts with the third contact section of the first terminal when any of the central conductive members of the first coaxial plug and second coaxial plug is not fitted in the hole of the insulation housing.

According to the second aspect of the present invention, when any of the central conductive members of the first coaxial plug and the second coaxial plug is not fitted in the hole of the insulation housing, the third contact section and the fourth contact section contact with each other, so that the first terminal and the second terminal are electrically connected to each other. When the central conductive member of the first coaxial plug is fitted in the hole of the insulation housing, the outer extending section of the central conductive member of the first coaxial plug touches the first contact section, so that the second terminal is pressed down by the insulation member of the first coaxial plug. Accordingly, the fourth contact section is moved away from the third contact section, so that the first terminal and the second terminal are electrically disconnected, and the central conductive member of the first coaxial plug and the first terminal are electrically connected to each other.

According to the second aspect of the present invention, when the central conductive member of the second coaxial plug is fitted in the hole of the insulation housing, the central conductive member of the second coaxial plug touches the second contact section, so that the second terminal is pressed down by the central conductive member of the second coaxial plug. Accordingly, the fourth contact section is moved away from the third contact section, so that the first terminal and the second terminal are electrically disconnected, and the central conductive member of the second coaxial plug and the second terminal are electrically connected.

According to the present invention, the coaxial connector with the switch is capable of switching a plurality of the terminals. Accordingly, it is possible to achieve high productivity and low manufacturing cost. Further, it is possible to improve operability without limiting a rotational angle upon insertion.

DETAILED DESCRIPTION OF THE PREFERRED EMBODIMENTS

Figure 1:
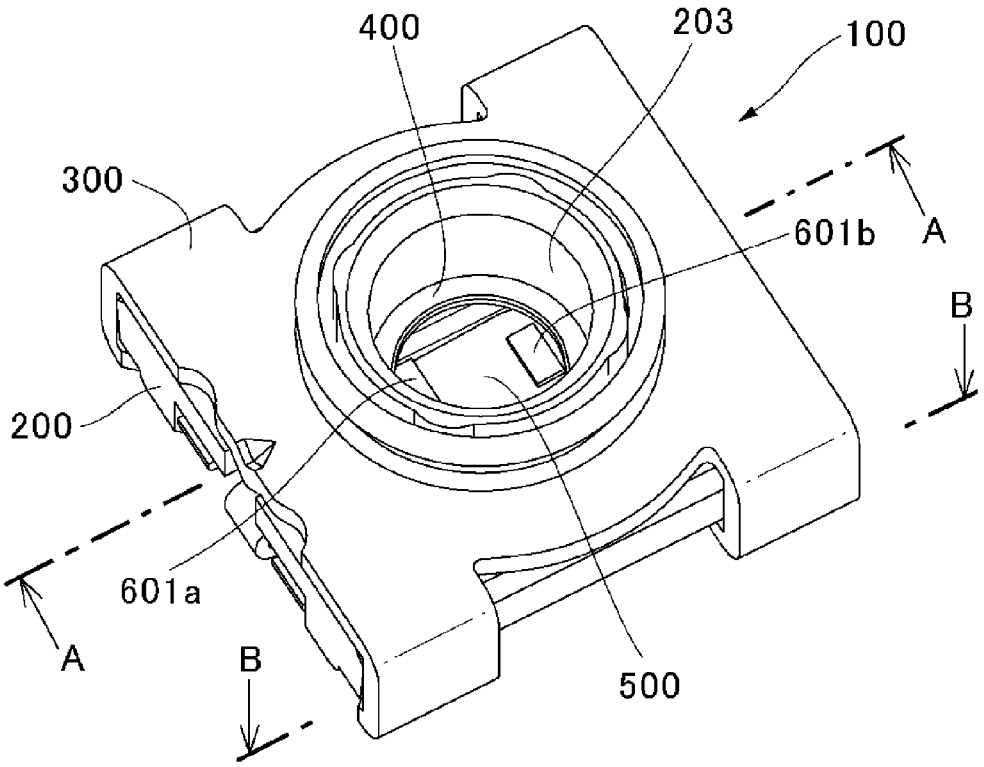
FIG. 1 is a perspective view showing a whole configuration of a coaxial connector according to an embodiment of the present invention.

Hereunder, referring to the accompanying drawings, embodiments of the present invention will be fully described. Here, in any figure that describes embodiments of the present invention, the same reference numerals are basically used for the same members and repetitive description will be omitted. The following embodiments of the present invention will be described in several sections or embodiments as necessary for convenience, but unless clearly stated, those sections or embodiments are related to each other, i.e. modification of a part or whole thereof, details, supplemental description, etc. Moreover, in the embodiments below, an amount of elements (including numbers, numerical values, volumes, and range) may be specifically referred, unless clearly stated or except a case that the amount is obviously limited to a specific one in principle, such amount shall not be limited to the specific one and can be greater than the specific one.

Figure 2:
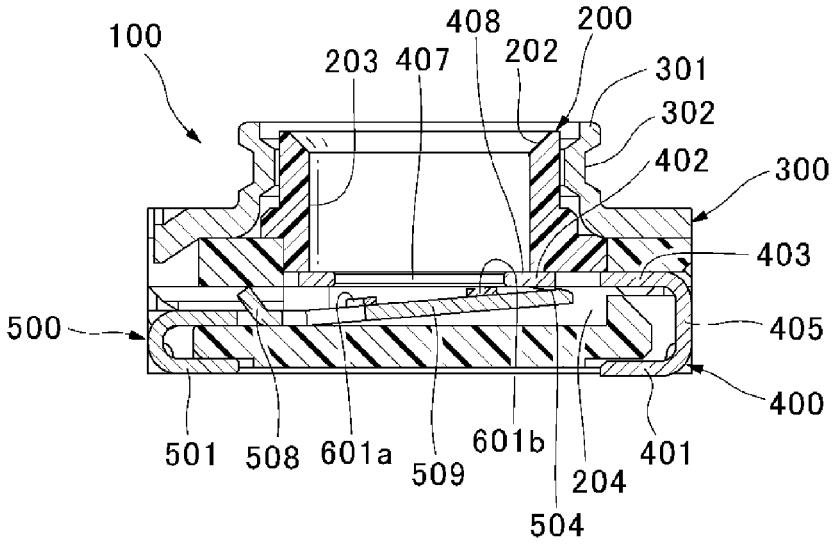
FIG. 2 is a sectional view showing the coaxial connector taken along a line A-A in FIG. 1 according to the embodiment of the present invention.
Figure 3:
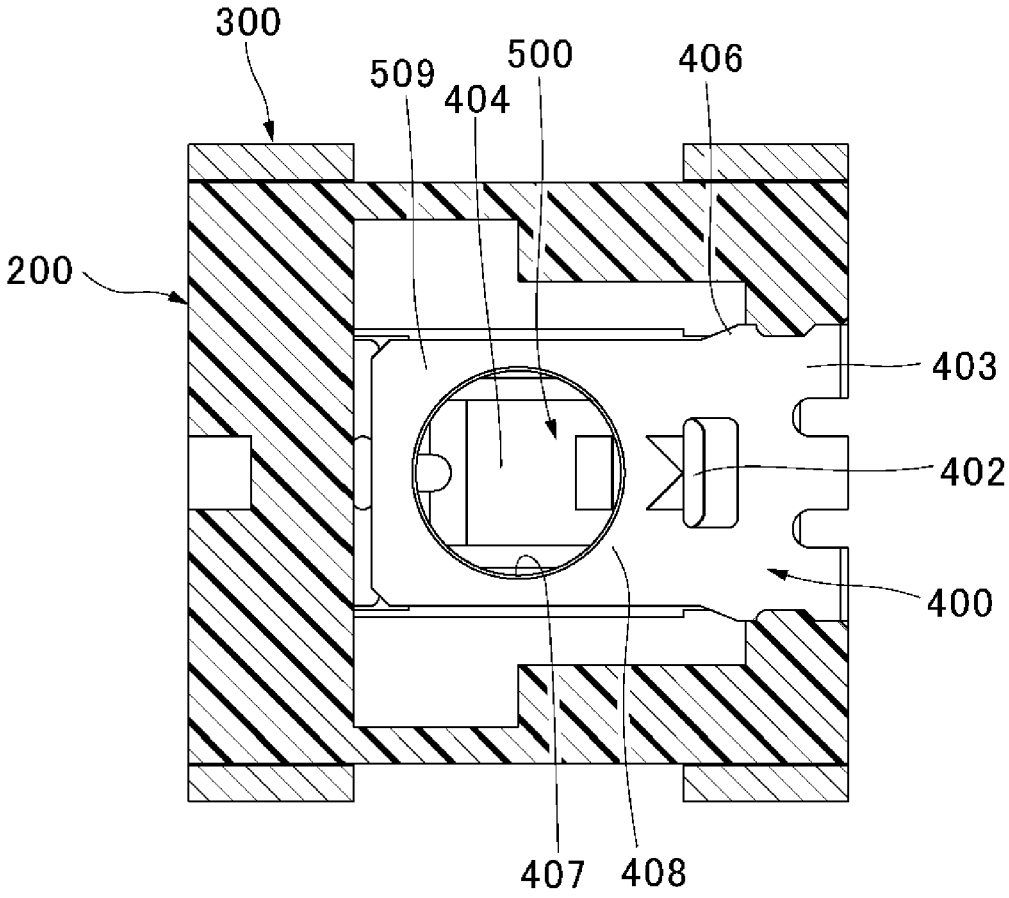
FIG. 3 is a sectional view showing the coaxial connector taken along a line B-B in FIG. 1 according to the embodiment of the present invention.

FIG. 1 is a perspective view showing a whole configuration of a coaxial connector according to an embodiment of the present invention. FIG. 2 is a sectional view of FIG. 1, taken along a surface A-A. FIG. 3 is a sectional view of FIG. 1, taken along a surface B-B. First, referring to FIG. 1-FIG. 3, a configuration of a coaxial connector according to the embodiment of the present invention will be described.

According to the embodiment, a coaxial connector 100 is a coaxial connector having a switch to be mounted on a substrate. The coaxial connector 100 includes a insulation housing 200 having a vertical hole 203 that can receive central conductive members 701*a* and 701*b* of a coaxial plug 700*a* or 700*b* (see FIGS. 8(*a*)-8(*b*), FIGS. 9(*a*)-9(*b*), and the like) from above; an outer conductive member 300 that is provided outside the insulation housing 200 and to/from which an outer conductive member 702*a* or 702*b* of coaxial plugs 700*a* or 700*b* can be attached/detached; a first terminal 400 that is provided under the vertical hole 203; a second terminal 500 that is provided under the vertical hole 203 and also under the first terminal 400; and an insulation member 601 that is provided between the first terminal 400 and the second terminal 500.

In the embodiment, the coaxial connector 100 can be mounted on a substrate, and can form a part of a substrate, being connected through a substrate connecting section 401 of the first terminal 400 and a substrate connecting section 501 of the second terminal 500, which are exposed outside.

In the embodiment, the coaxial connector 100 may be used for testing of characteristics, inspections, or the like of a built-in high-frequency circuit and an antenna in a portable information communication device such as cellular phones, smartphones, notebook computers, and tablet-type personal computers. Moreover, for high-frequency circuits, the outer conductive member 300 is shielded, and the first terminal 400 and the second terminal 500 are impedance-matched.

In the embodiment, the insulation housing 200 may be formed, for example, from insulating resin such as plastics. The insulation housing 200 has a main body part that is generally rectangular parallelepiped, and an upper part of generally center thereof has a cylindrical shape. In addition, on an upper surface of the insulation housing 200, there is formed a conical recess 202, and on a center part of a bottom surface of the recess 202, there is provided a vertical hole 203 that can receive the central conductive member 701*a* or 701*b* of the coaxial plug 700*a* or 700*b* from thereabove. Furthermore, under the vertical hole 203, there is formed a horizontally long space 204 that connects to the vertical hole 203, and once the coaxial plug 700*a* or 700*b* is attached thereto, an end of the central conductive member 701*a* or 701*b* enters the vertical hole 203 and reaches the space 204. Here, the insulation housing 200 can be divided into, for example two components, and has a configuration that is suitable for integrating the first terminal 400, the second terminal 500, and so on.

In the embodiment, the outer conductive member 300 may be formed, for example, by punching a conductive material such as sheet metal and then bending. On an upper surface of the outer conductive member 300, there is provided a cylindrical upper section 301. Upon inserting the coaxial plug, a lower end section of the outer conductive member 702*a* or 702*b* of the coaxial plug 700*a* or 700*b* touches the upper section 301, and becomes electrically connected to the outer conductive member 300 of the coaxial connector 100. In addition, on an outer circumferential surface of the upper part 301 of the outer conductive member 300, there is formed an annular groove 302 having a semicircular shape in the a sectional view, such that, upon inserting another type of a coaxial plug (not illustrated), a lower end section of the outer conductive member 702*a* or 702*b* of the coaxial plug can be fitted in the annular groove 302.

Figure 4:
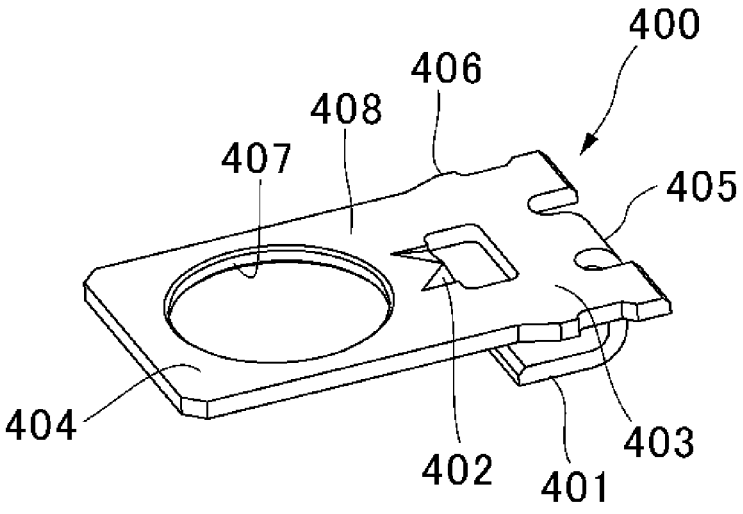
FIG. 4 is a perspective view showing an example of a first terminal of the coaxial connector according to the embodiment of the present invention.

FIG. 4 is a perspective view showing a configuration example of the first terminal 400. The first terminal 400 may be formed, for example, by punching sheet metal of a conductive material, such as beryllium copper, phosphor bronze, ternary copper, and Corson copper and then bending. The first terminal 400 includes flat securing sections 403; an extending section 404 that extends from the securing sections 403 towards a center of the insulation housing 200; a substrate connecting section 401 provided at a end section that is formed being bent to a square bottomed U-shape from a basal end side of the securing sections 403; and an arm section 405 provided between the securing sections 403.

In the embodiment, the extending section 404 has a circular hole 407 having a diameter smaller than the vertical hole 203, right under the vertical hole 203, such that a thin central conductive member 701*b* of the coaxial plug 700*b* can put therethrough. On side sections of the securing section 403, there is formed a wedge-shaped projection 406, and via those projections 406, the securing sections 403 are pressed in the space 204, while keeping its horizontal attitude, through an insertion hole of the insulation housing 200 from a side of the insulation housing 200.

In the embodiment, as a result, the securing sections 403 are disposed inside the insulation housing 200, and other parts, the arm section 405 and the substrate connecting sections 401, remain in a state of being exposed to outside the insulation housing 200. Moreover, in a generally middle part between the securing section 403 and the extending section 404, there is provided a contact section (third contact section) 402 that protrudes downward, which thereby enables to increase pressure to contact with a contact section (fourth contact section) 504 of the second terminal 500 and enhance the contact reliability.

Figure 5:
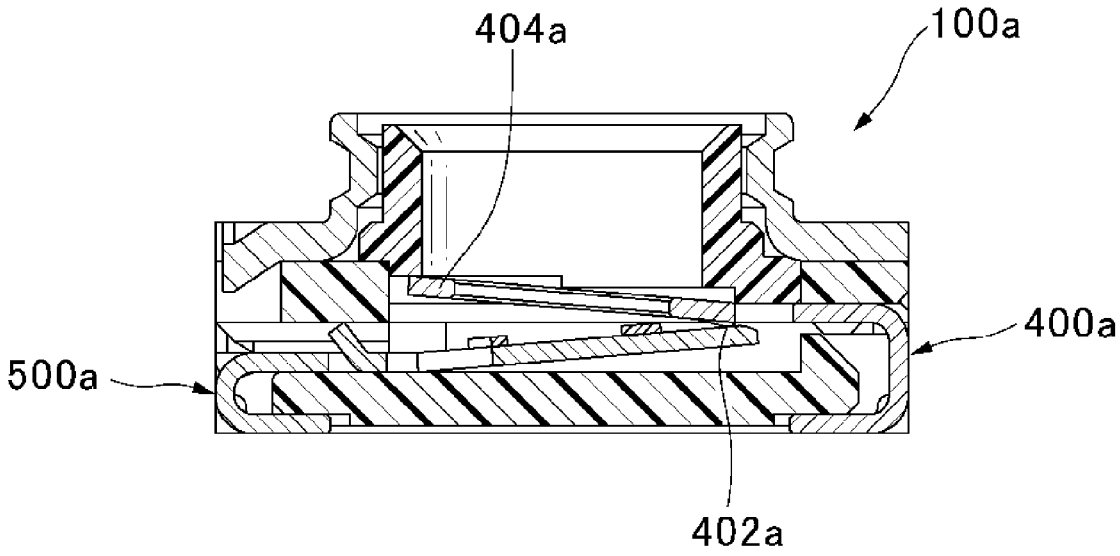
FIG. 5 is a sectional view showing a coaxial connector according to another embodiment of the present invention.

FIG. 5 is a sectional view showing a coaxial connector 100*a* according to another embodiment of the present invention. In the coaxial connector 100*a* of FIG. 5, the extending section 404*a* of the first terminal 400*a* is slightly tilted up for elastic deformation, and with the elastic force, it is possible to enhance reliability of contact thereof with the central conductive members 701*a* or 701*b* of the coaxial plugs 700*a* or 700*b*.

In addition, upon contacting with the central conductive member 701*a* or 701*b*, as the extending section 404*a* is pressed down, the contact section 402*a* of the first terminal 400*a* and the contact section 504 of the second terminal 500 rub against each other, there is a cleaning effect of the contact sections 402*a* and 504. Here, since it is possible to divide the insulation housing 200, for example, into two elements, it is suitable to integrate an elastic piece extending upward, such as the extending section 404*a*.

Figure 6:
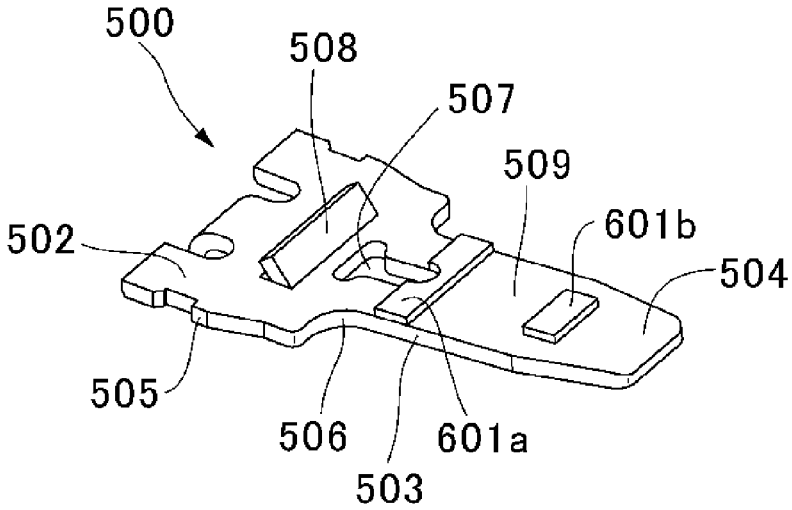
FIG. 6 is a perspective view showing an example of a second terminal of the coaxial connector according to the embodiment of the present invention.

FIG. 6 is a perspective view showing a configuration example of the second terminal 500. The second terminal 500 may be formed, for example, by punching sheet metal of a conductive material, such as beryllium copper, phosphor bronze, ternary copper, and Corson copper and then bending. The second terminal 500 includes flat securing sections 502; a substrate connecting section 501 (see FIG. 2) that is formed being bent downward to a U-shape from a basal end side of the securing sections 502; and an elastic section 503 that extends from the securing sections 502 diagonally upward like a cantilever in the end direction.

In the embodiment, the contact section (second contact section) 509 provided at generally center of the elastic section 503 can contact with a thin central conductive member 701*b* of the coaxial plug 700*b*, and has a contact section (fourth contact section) 504 on the end side relative to the contact position. The contact section 504 can contact with a lower end of the contact section (third contact section) 402 of the first terminal 400. On a side section of each securing section 502, there is formed a wedge-like projection 505.

In the embodiment, the securing sections 502 are pressed in the space 204 of the insulation housing 200, while keeping its horizontal attitude, via the projections 505 from the side opposite the press-in direction of the first terminal 400. The both side outer circumferential sections 506 of the elastic section 503 is widened from near the contact position towards the securing sections 502 of the second terminal 500 and have concave shapes. In addition, on the elastic section 503, there is provided a cutaway section 507 near the securing sections 502 relative to the contact position, and the cutaway section 507 extends along the elastic section 503. In addition, on the securing section 502, there is also provided a rising piece 508, and with the rising piece 508, it is possible to prevent entrance of foreign substances from the insertion hole present on the side thereof.

Furthermore, on an upper surface of the second terminal 500, an insulating film (resist) is applied in two lines, which are juxtaposed to each other, but perpendicular to the extending direction of the elastic section 503, at a position that is away from a position where the end of the thin central conductive member 701*b* of the coaxial plug 700*b* (near the center of the vertical hole 203) but at a part where a part of the end section of the central conductive member 701*a*, which has an outer extending section of the coaxial plug 700*a*, contacts with, and thereby two insulation members 601*a* and 601*b* are formed. Moreover, the insulation member 601*b* provided, which is to be disposed near the first terminal 400, is configured short so as to avoid interference with the first terminal 400.

With this configuration, when a coaxial plug is not inserted, it is possible not to prohibit the contact between the third contact section 402 and the fourth contact section 504. Here, the insulation members 601 and 602 can be also formed by integral molding instead of applying the insulation member. Moreover, instead of applying the insulation members, the insulation members 601 and 602 can be formed as oxide films by oxidizing a surface of the second terminal 500 with laser irradiation.

Figure 7A:
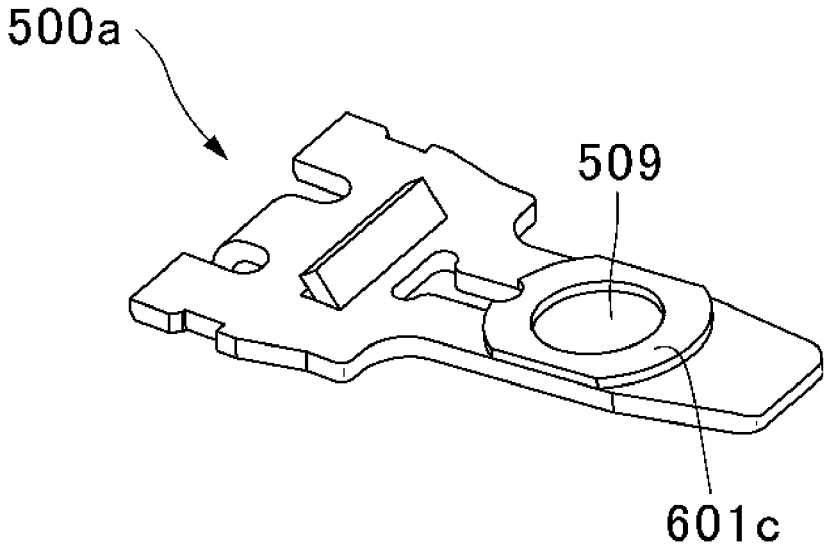
FIGS. 7(*a*) and 7(*b*) are perspective views showing examples of the second terminal of the coaxial connector according to another embodiment of the present invention, in which an insulation member is provided on an upper surface of the second terminal, wherein FIG. 7(*a*) shows an O-shaped insulation member and FIG. 7(*b*) shows a cylindrical insulation member.
Figure 7B:
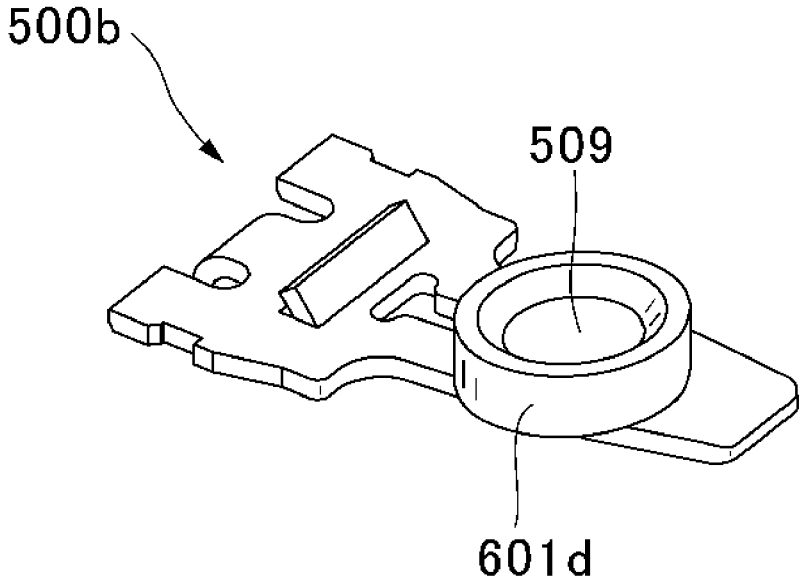

FIGS. 7(*a*) and 7(*b*) are perspective views showing configuration examples of a second terminal 500, in which an insulation member 601 is provided on an upper surface of the second terminal 500 of the coaxial connector according to another embodiment of the present invention.

As shown in FIGS. 7(*a*) and 7(*b*), the insulation member 601 can be embodied in various forms. For example, as shown in FIG. 7(*a*), applying an insulating film on an upper surface of a second terminal 500*a*, it is possible to form an O-shaped insulation member 601*c* thereon. Moreover, as shown in FIG. 7(*b*), it is also possible to form a cylindrical insulation member 601*d* by integral molding of resin onto an upper surface of the second terminal 500*b*.

Figure 8A:
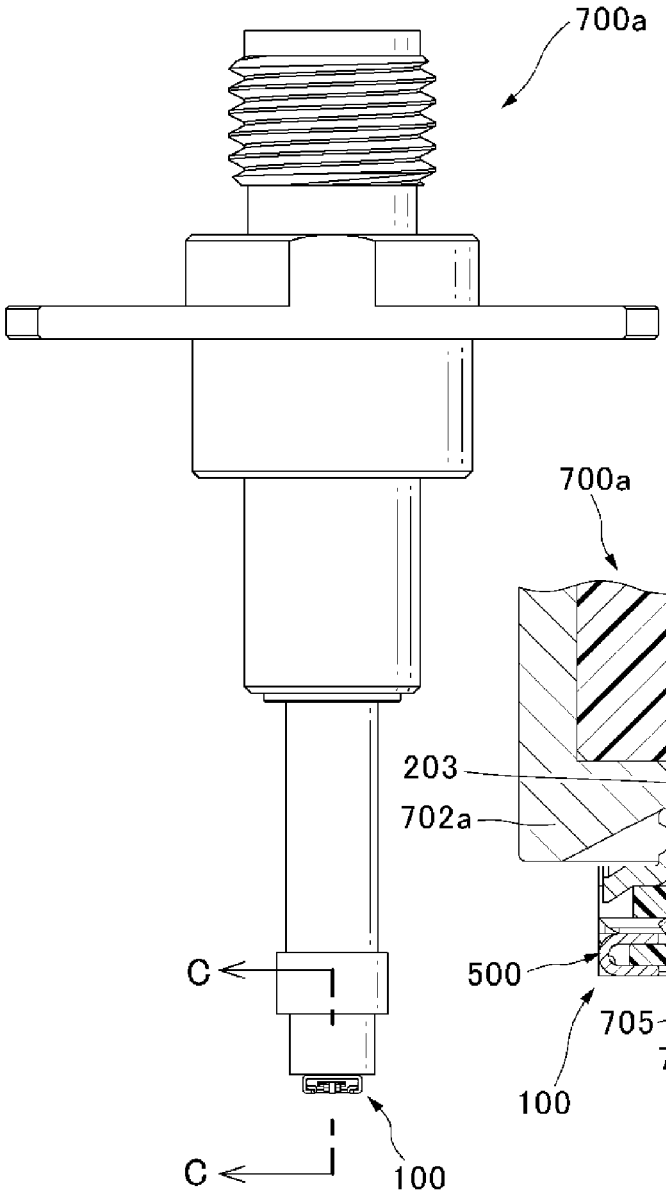
FIGS. 8(*a*) and 8(*b*) are views showing the coaxial connector in a state that a coaxial plug having an extending section is fitted into the coaxial connector according to the embodiment of the present invention, wherein FIG. 8(*a*) is a side view of the coaxial connector and FIG. 8(*b*) is an enlarged sectional view showing the coaxial connector taken along a line C-C in FIG. 8(*a*)
Figure 8B:
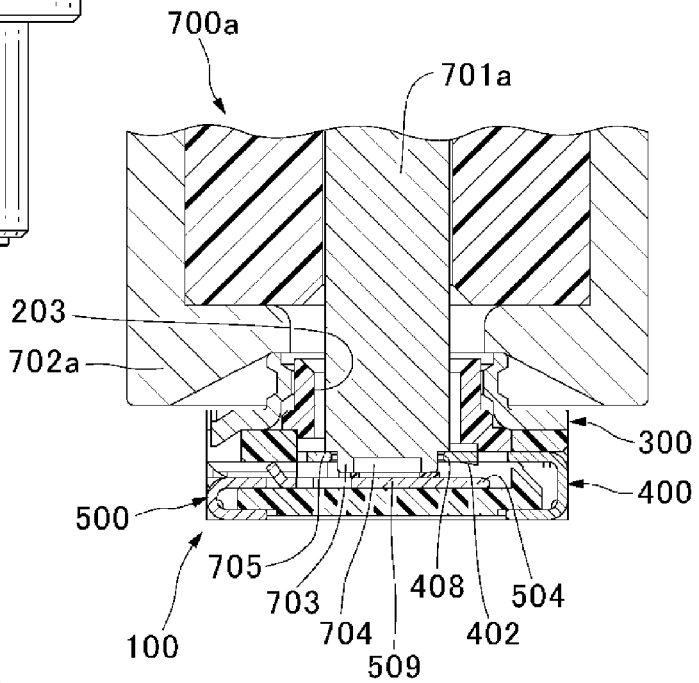
Figure 9A:
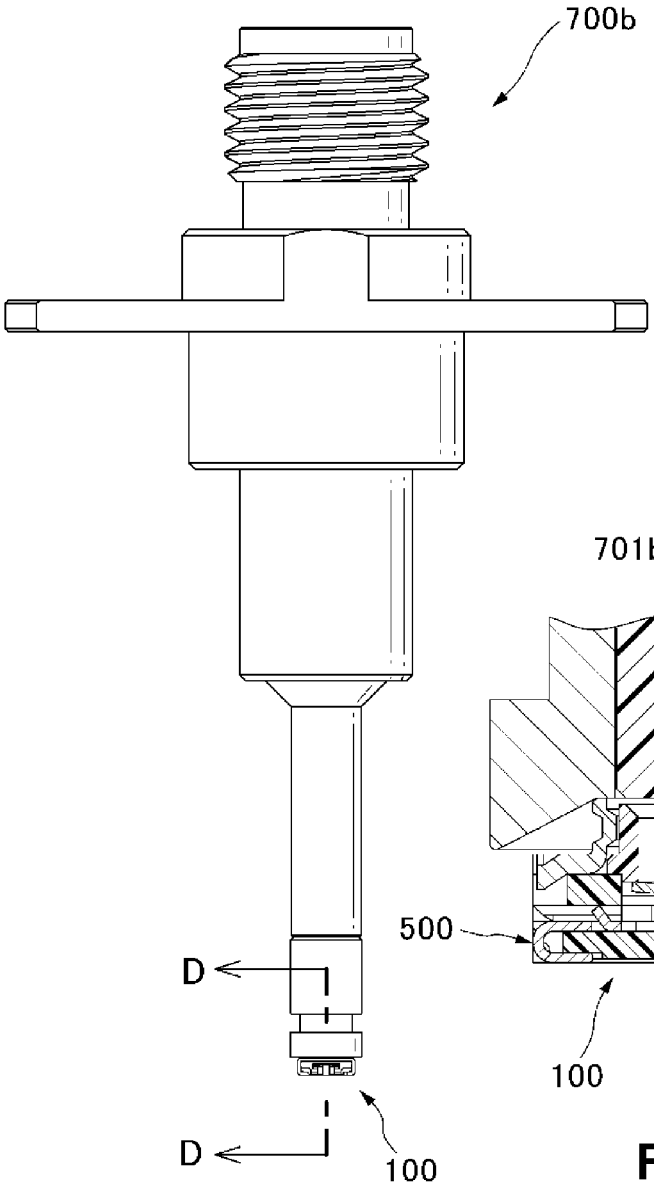
FIGS. 9(*a*) and 9(*b*) are views showing the coaxial connector in a state that a coaxial plug without the extending section is fitted into the coaxial connector according to the embodiment of the present invention, wherein FIG. 9(*a*) is a side view of the coaxial connector and FIG. 9(*b*) is an enlarged sectional view showing the coaxial connector taken along a line D-D in FIG. 9(*a*)
Figure 9B:
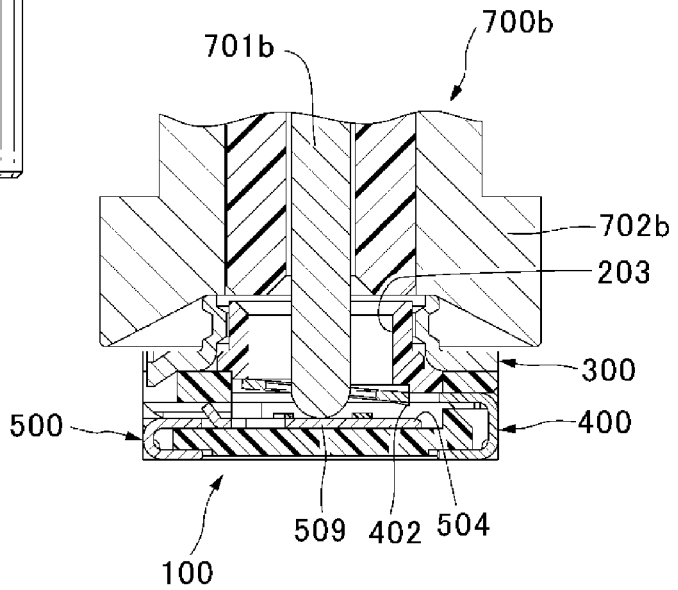

FIGS. 8(*a*) and 8(*b*) are views showing a state in which the coaxial plug 700*a* having an outer extending section 705 is fitted in the coaxial connector 100, wherein FIG. 8(*a*) is a whole view and FIG. 8(*b*) is an enlarged sectional view near the coaxial connector 100. FIGS. 9(*a*) and 9(*b*) are views showing a state in which the coaxial plug 700*b* without an extending section is fitted in the coaxial connector 100, wherein FIG. 9(*a*) is a whole view and FIG. 9(*b*) is an enlarged sectional view near the coaxial connector 100.

In inspection, coaxial plugs having at least two types of end sections are used. Here, in this specification, an "end section" of a central conductive member refers to an end section in an axial direction of the central conductive member, which is a part to be inserted in the vertical hole of the coaxial connector. In addition, an "end part" of the central conductive member is a part of the "end section", which is a part that touches with the second terminal. Furthermore, an "outer extending section" is a part of the "end section", which is an annular portion provided around the "end part".

In case of electrically disconnecting between the first terminal 400 and second terminal 500 and electrically connecting between the first terminal 400 and the central conductive member of the coaxial plug in order to measure antenna characteristics or the like, a first coaxial plug 700*a*, in which an end section of the central conductive member has a large diameter, is used.

As shown in FIG. 8(*b*), the end part of the coaxial plug 700*a* has an annular protrusion 703, a sectional view of which has a step-like shape, and which protrudes downward from a lower end position of the extending section 705. On an inner side of the protrusion 703, there is provided a cylindrical recess 704 so as to cut to the same position as a lower surface of the first terminal 400. The protrusion 703 is provided at a position that go through the hole 407 of the first terminal 400, but a diameter of an outer circumferential part of the protrusion 703 is larger than that of the hole 407 and forms an extending section 705.

In the embodiment, the protrusion 703 is configured to touch the insulation members 601*a* and 601*b* on the second terminal 500. With an inner-side center of the protrusion 703 is formed as a recess 704 or the insulation member has a certain thickness, the central conductive member 701*a* has a configuration not to contact with the contact section 509 of the second terminal 500. In addition, upon inserting the coaxial plug 700*a*, the central conductive member 701*a* touches the contact section 408 of the first terminal 400. Here, with the recess 704, it is possible to reduce isolation from the second terminal 500. Moreover, the coaxial plug is elastically supported to the plug main body, such that the outer conductive member 702*a* or 702*b* can displace in an up-and-down direction with the plug insulating body, and the central conductive member is also independently elastically supported so as to be capable of displacing.

In case of electrically disconnecting between the first terminal 400 and second terminal 500 and electrically connecting between the second terminal 500 and the central conductive member of the coaxial plug in order to measure characteristics of high-frequency circuit or the like, a second coaxial plug 700*b*, in which an end section of the center connector has a smaller diameter than that of the first coaxial plug 700*a*, is used. The diameter of the end section of the central conductive member 701*b* of the second coaxial plug 700*b* is smaller than that of the hole 407 of the first terminal 400 so as to be able to go through the hole 407. The end section of the central conductive member 701*b* is configured to touch the contact section 509 of the second terminal 500. Here, the connecting relation between the antenna and the high-frequency circuit can be opposite to that in the above description.

When the coaxial plug 700*a* or 700*b* are not attached, the contact section (fourth contact section) 504 of the second terminal 500 is pressed onto the contact section (third contact section) 402 of the first terminal 400 by elastic force of the elastic section 503, the first terminal 400 and the second terminal 500 keep the electrically connected state.

When the first coaxial plug 700*a* having the outer extending section 705 is attached, a lower end section of the outer conductive member 702*a* of the first coaxial plug 700*a* touches the outer conductive member 300, and the end section of the central conductive member 701*a* of the coaxial plug 701*a* is put through the vertical hole 203. In this state, the protrusion 703 of the end part of the central conductive member 701*a* of the coaxial plug 700*a* touches the insulation member 601 of the elastic section 503.

At this time, since the elastic force of the central conductive member 701*a* of the coaxial plug 700*a* is stronger than that of the elastic section 503, the elastic section 503 is pressed down by the central conductive member 701*a* of the coaxial plug 700*a* to elastically deform, the contact section 504 moves away from the contact section 402, and the first terminal 400 and the second terminal 500 are electrically disconnected.

At the same time, the outer extending section 705 of the end section of the central conductive member 701*a* of the coaxial plug 700*a* touches the contact section (first contact section) 408 of the outer edge of the hole 407 of the extending section 404 of the first terminal 400, and the central conductive member 701*a* of the coaxial plug 700*a* and the first terminal 400 are in connected state. As such, it is possible to flow signals, which flew from the first terminal 400 to the second terminal 500, from the first terminal 400 to the central conductive member 701*a* of the coaxial plug 700*a* so as to inspect the antenna.

In the embodiment, the second contact section 509, the fourth contact section 504, and the insulation member 601 are preferably in positions relative to each other so as to block the connection between the third contact section 402 and the fourth contact section 504. More specifically, since there is provided the fourth contact section 504 on a free end side of the cantilever-like second terminal 500, which the insulation member 601 touches at near the basal section side thereof relative to the position of the contact section, the amount of deformation of the fourth contact section 504, which is on the free end side, is greater than that of the abutted section.

When the second coaxial plug 700*b* having a central conductive member, in which an end section has a small diameter, a lower end of the outer conductive member 702*b* of the second coaxial plug 700*b* touches the outer conductive member 300, and an end section of the central conductive member 701*b* of the coaxial plug 700*b* is put through the vertical hole 203. In this state, the central conductive member 701*b* of the coaxial plug 700*b* touches the contact section (second contact section) 509 of the elastic section 503.

At this time, since elastic force of the central conductive member 701*b* of the coaxial plug 700*b* is stronger than the elastic section 503, the elastic section 503 is pressed down by the central conductive member 701*b* of the coaxial plug 700*b* and elastically deforms, the contact section 504 moves away from the contact section 402, so that the first terminal 400 and second terminal 500 are electrically disconnected, and the central conductive member 701*b* of the coaxial plug 700*b* and the second terminal 500 are in a connected state. As such, signals, which flew from the second terminal 500 to the first terminal 400, are made flow from the second terminal 500 to the central conductive member 701*b* of the coaxial plug 700*b*, and it is possible to inspect the high-frequency circuit.

Figure 10A:
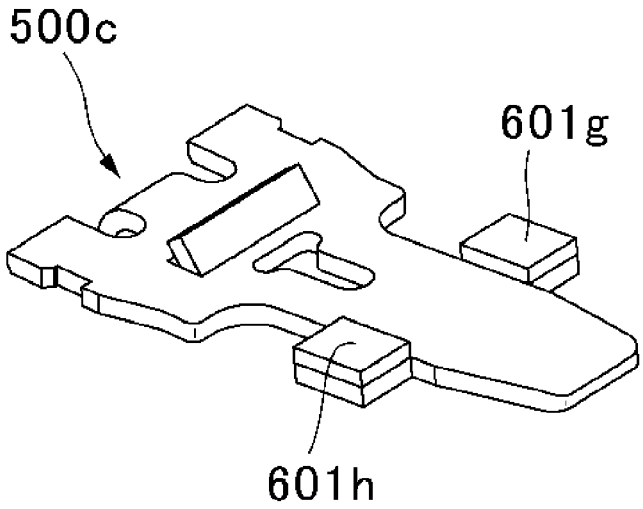
FIGS. 10(*a*) and 10(*b*) are perspective views showing a configuration example, in which an insulation member is provided on both a lower surface of the first terminal of the coaxial connector and an upper surface of the second terminal according to another embodiment of the present invention, wherein FIG. 10(*a*) shows a configuration of the second terminal and FIG. 10(*b*) shows a combination of the first terminal and the second terminal.
Figure 10B:
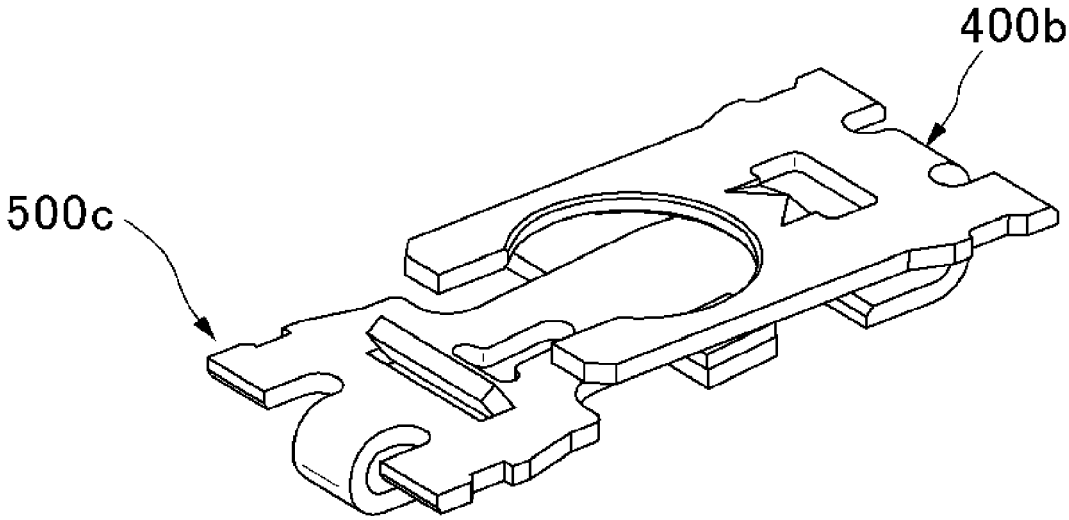

FIG. 10 is a perspective view showing a configuration example, in which the insulation member 601 is provided on both a lower surface of the first terminal 400 of the coaxial connector and an upper surface of the second terminal 500 according to another embodiment of the present invention, wherein FIG. 10(*a*) shows a configuration of the second terminal 500*c* and FIG. 10(*b*) shows a combination of the first terminal 400*b* and the second terminal 500*c*.

As shown in FIG. 10, even when the insulation member 601 is provided on both the lower surface of the first terminal 400 and the upper surface of the second terminal 500, it is possible to obtain similar effect. In this case, with the first terminal 400*b* is pressed down by the central conductive member having a large diameter, the insulation members 601*e* and 601*f* of the lower surface of the first terminal 400*b* and the insulation members 601*g* and 601*h* of the upper surface of the second terminal 500*c* touch each other, and the second terminal 500*c* is also pressed down, so that it is possible to block the contact between the first terminal 400*b* and the second terminal 500*c*.

More specifically, even in case of a central conductive member that does not have the protrusion 703 like the one show in FIGS. 8(*a*) and 8(*b*), it is possible to block the electrical connection between the first terminal 400*b* and the second terminal 500*c* without pressing down the insulation member 601 directly by the central conductive member 701*a* or 701*b*.

Figure 11:
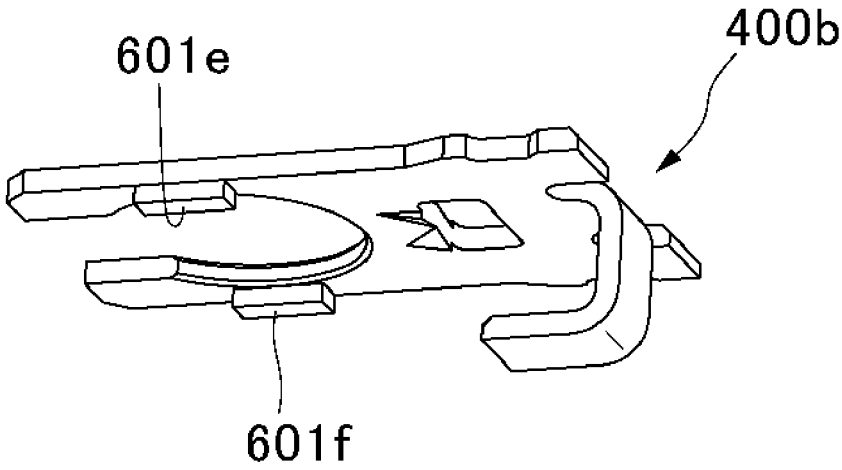
FIG. 11 is a perspective view showing a configuration, in which the insulation member is provided on a lower surface of the first terminal of the coaxial connector according to another embodiment of the present invention.

FIG. 11 is a perspective view showing a configuration, in which the insulation member 601 is provided on a lower surface of the first terminal 400 of the coaxial connector according to another embodiment of the present invention. FIG. 11 shows a perspective view of a configuration, which includes the insulation member 601 on a lower surface of the first terminal 400 of the coaxial connector according to another embodiment of the present invention.

As shown in FIG. 11, it is also possible to provide the insulation members 601*e* and 601*f* on a lower surface of the terminal 400*b*. In this case, as the first terminal 400*b* is pressed down by the central conductive member having a large diameter, the second terminal 500 is also pressed down by operation of the insulation members 601*e* and 601*f*, so that it is possible to block the contact between the first terminal 400*b* and the second terminal 500*c*. More specifically, even in case of a central conductive member not having the protrusion 703 like the one shown in FIGS. 8(*a*) and 8(*b*), it is possible to block the electrical connection between the first terminal 400*b* and the second terminal 500*c* without directly pressing down the insulation member 601 by the central conductive member 701*a* or 701*b*.

Figure 12:
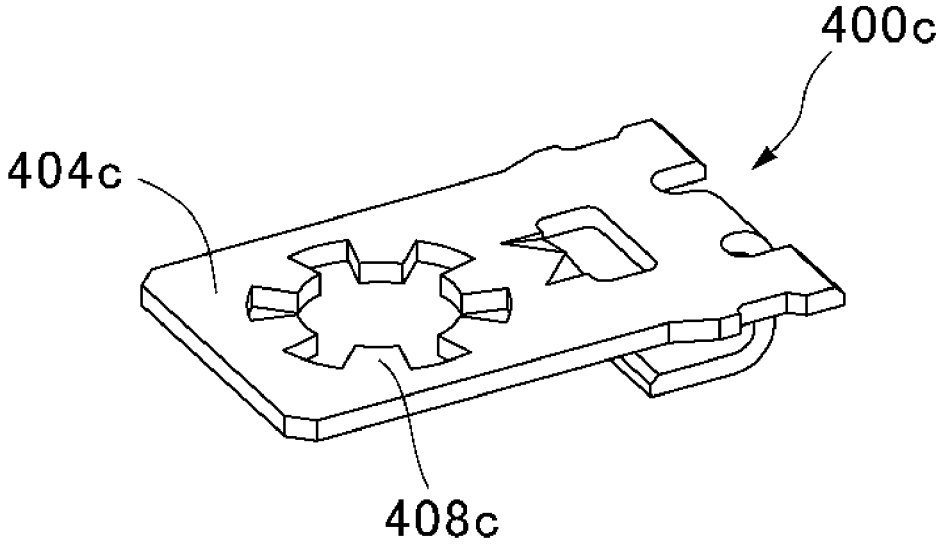
FIG. 12 is a perspective view showing another configuration example of the first terminal of the coaxial connector according to the embodiment of the present invention.

FIG. 12 is a perspective view showing another configuration example of the first terminal, similarly to FIG. 5. The first terminal 400*c* shown in FIG. 12 has a first contact section 408*c* that is cut and lifted for elastic deformation around the hole at a part where the outer extending section of the central conductive member of the coaxial plug touches.

With this configuration, upon fitting of the coaxial plug, the whole extending section 404*c* of the first terminal 400*c* does not elastically deform like the elastic section 404*a* of FIG. 5, but only the contact section 408*c* elastically deforms.

Figure 13A:
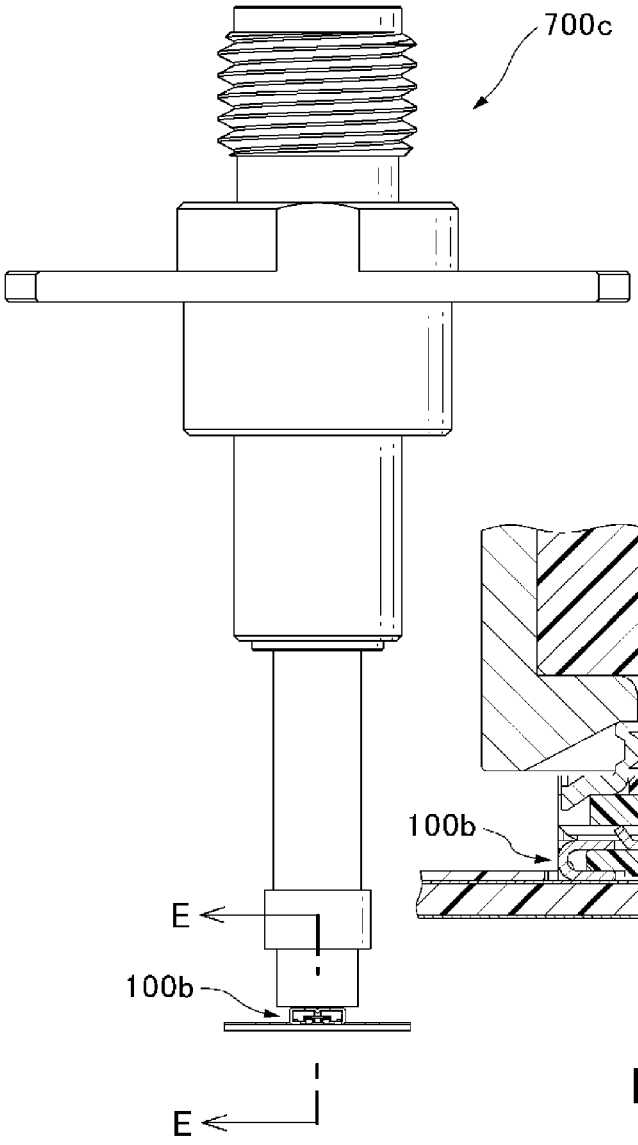
FIGS. 13(*a*) and 13(*b*) are views showing the coaxial connector in a state that a coaxial plug having an extending section is fitted into the coaxial connector according to another embodiment of the present invention, wherein FIG. 13(*a*) is a side view of the coaxial connector and FIG. 13(*b*) is an enlarged sectional view showing the coaxial connector taken along a line E-E in FIG. 13(*a*)
Figure 13B:
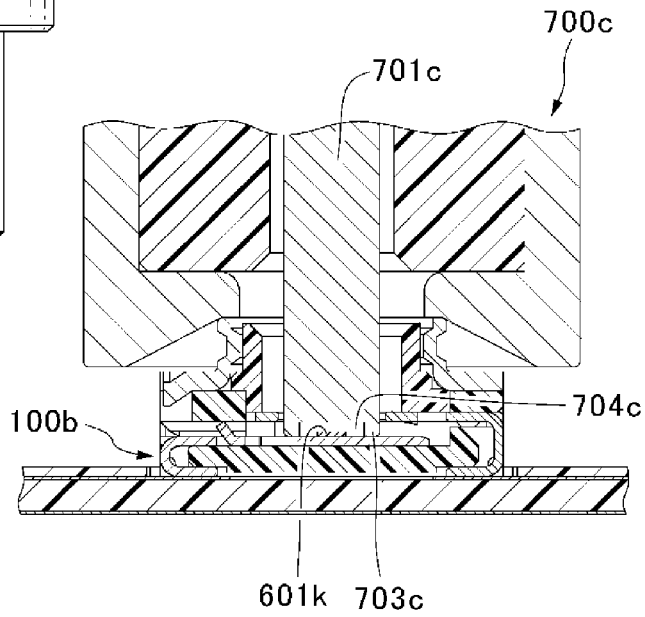
Figure 14A:
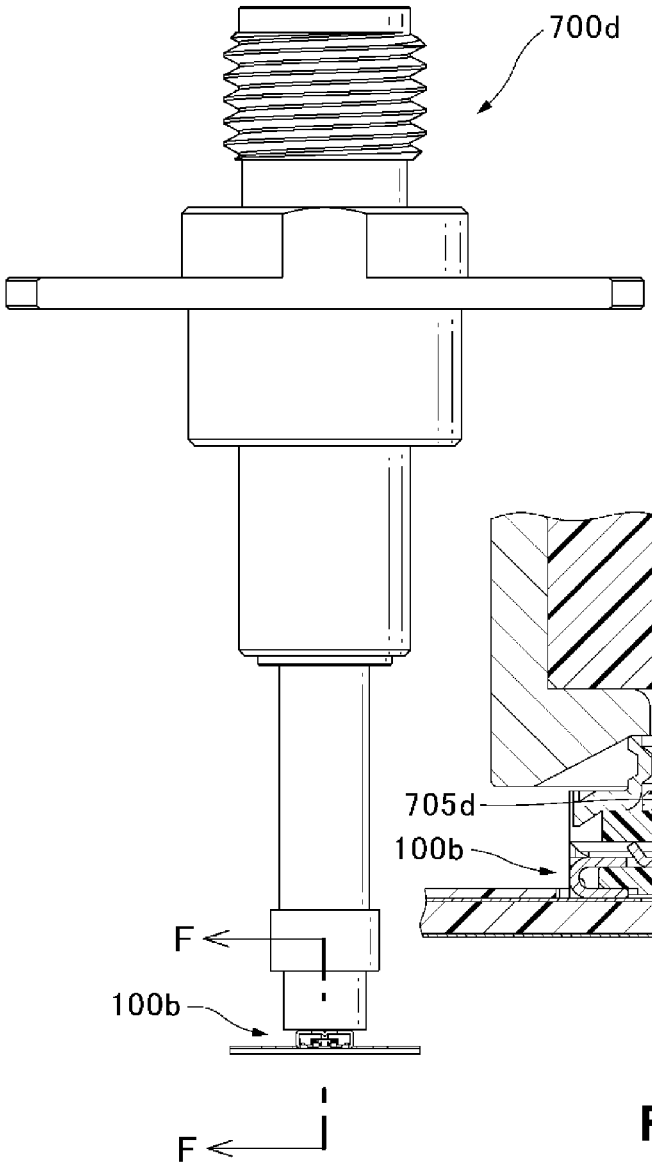
FIGS. 14(*a*) and 14(*b*) are views showing the coaxial connector in a state that a coaxial plug without the extending section is fitted into the coaxial connector according to another embodiment of the present invention, wherein FIG. 14(*a*) is a side view of the coaxial connector and FIG. 14(*b*) is an enlarged sectional view showing the coaxial connector taken along a line F-F in FIG. 14(*a*)
Figure 14B:
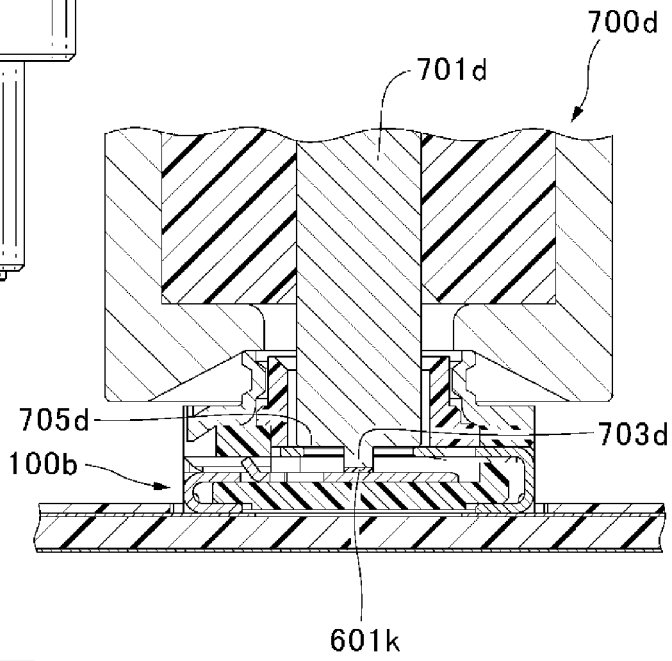

FIGS. 13(*a*)-13(*b*) and FIGS. 14(*a*)-14(*b*) show states, in which a coaxial plug 700*c* or 700*d* is fitted in the coaxial connector 100*b* according to another embodiment of the present invention, wherein FIGS. 13(*a*) and 14(*a*) show the whole view and FIGS. 13(*b*) and 14(*b*) are enlarged sectional views near the coaxial connector 100*b*.

In the coaxial connector 100*b* shown in FIGS. 13(*a*)-13(*b*) and FIGS. 14(*a*)-14(*b*), at a position of the second contact section 509 of the second terminal 500, there is provided an insulation member 601*k*. In addition, as shown in FIGS. 13(*a*)-13(*b*), in the coaxial plug 701*c* having a small diameter, there are provided a concave section 704*c* at a center of the end part (a part that the insulation member 601*k* touches) and a protrusion 703*c* therearound.

Moreover, as shown in FIGS. 14(*a*)-14(*b*), in the coaxial plug 701*d* having a large diameter, there are provided a protrusion 703*d* at a center of the end part (part that the insulation member 601*k* touches) and an extending section 705*d* therearound. As such, by providing the outer extending section 705*d* in the coaxial plug 701*d* and omitting the outer extending section from the coaxial plug 701*c*, it is possible to obtain similar effect to that of the aforementioned embodiment.

Figure 15A:
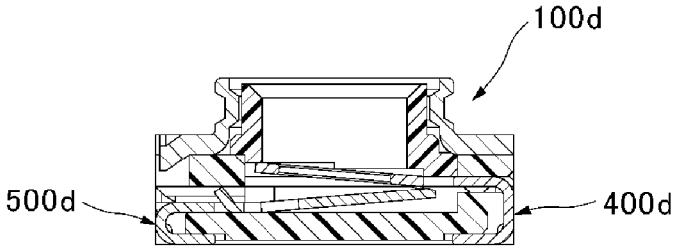
FIGS. 15(*a*) to 15(*c*) are sectional views showing a coaxial connector according to another embodiment of the present invention, wherein FIG. 15(*a*) only shows the coaxial connector, FIG. 15(*b*) shows a state where a coaxial plug is fitted in the coaxial connector and a central conductive member is not inserted in the coaxial connector, and FIG. 15(*c*) shows a state where the coaxial plug is fitted in the coaxial connector and the central conductive member is inserted in the hole of the coaxial connector.
Figure 15B:
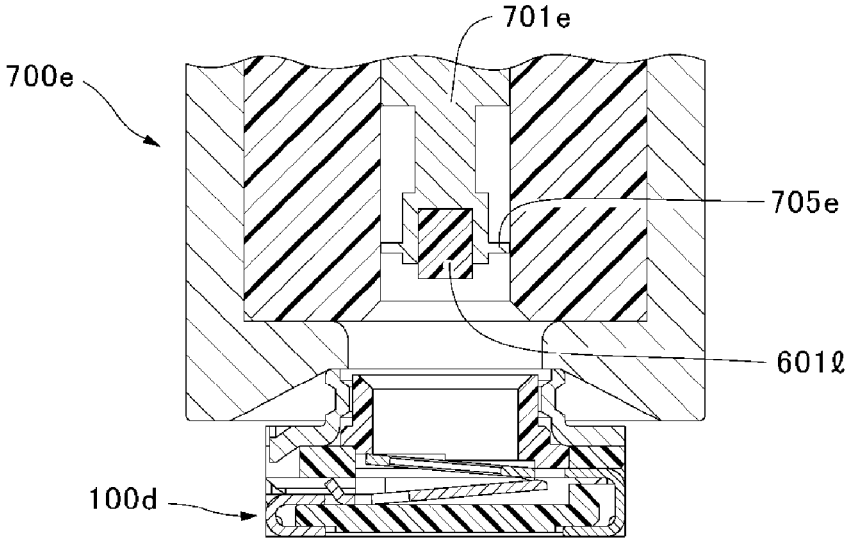
Figure 15C:
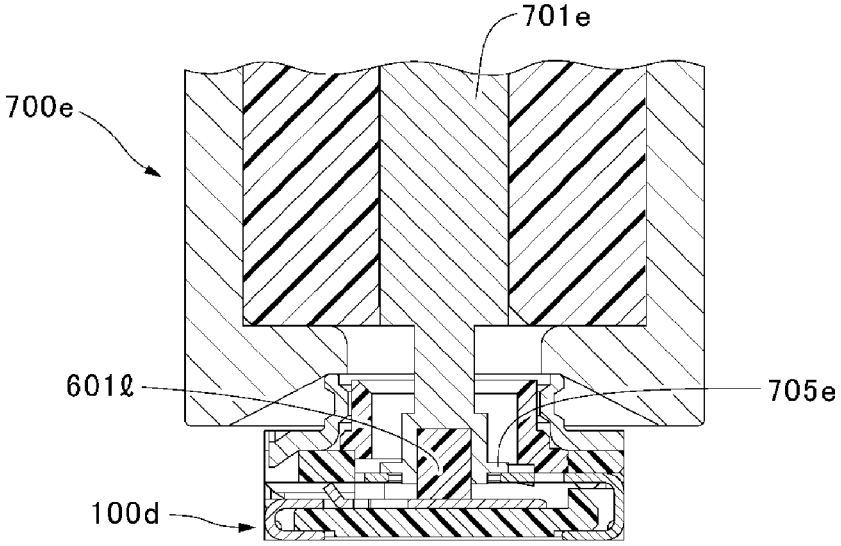

FIGS. 15(*a*) to 15(*c*) are sectional views showing a coaxial connector according to another embodiment of the present invention, wherein FIG. 15(*a*) only shows the coaxial connector, FIG. 15(*b*) shows a state where a coaxial plug is fitted in the coaxial connector and a central conductive member is not inserted in the coaxial connector, and FIG. 15(*c*) shows a state where the coaxial plug is fitted in the coaxial connector and the central conductive member is inserted in the hole of the coaxial connector.

The coaxial connector 100*d* shown in FIGS. 15(*a*) to 15(*c*) does not have an insulation member 601. But instead, the coaxial plug 700*e* includes an insulation member 601*l*. At an end part of the central conductive member 701*e* of the coaxial plug 700*e*, there is provided the insulation member 601*l* and also provided an extending section 705*e* therearound. As such, when the end section of the central conductive member 701*e* of the coaxial plug 700*e* is inserted in a hole of the coaxial connector 100*d*, the second terminal 500*d* is pressed down by the insulation member 601*l*, so that the electrical connection between the first terminal 400*d* and the second terminal 500*d* is blocked, and the outer extending section 705*e* of the central conductive member 701*e* touches the first terminal 400*d* so as to electrically connect therebetween. With this configuration, it is possible to obtain similar effect to the one in the aforementioned embodiment.

Furthermore, although not specifically illustrated, the insulation member 601 can be provided between the first terminal 400 and second terminal 500 in a floating state, instead of providing on a surface of the first terminal 400 or the second terminal 500. In addition, without securing the insulation member 601*d* of FIG. 7(*b*) on a surface of the second terminal 500*b*, it is also possible to dispose the insulation member 601*d* so as to be movable in the hole 407 of the first terminal 400.

In this case, in case of not fitting the coaxial plug, i.e., when the first terminal 400 and the second terminal 500 contact with each other, if the upper surface of the cylindrical insulation member 601*d* is configured to protrude above the upper surface of the first terminal 400, when a thick central conductive member having a flat end part is fitted, the insulation member 601*d* is pressed down, so that the connection between the first terminal 400 and second terminal 500 is blocked, and the outer extending section 705 of the thick central conductive member touches the first terminal 400 to electrically connect thereto. In this specification, "between the first terminal 400 and the second terminal 500" means that the insulation member 601 can be provided anywhere as long as a part of the insulation member 601 is therebetween. For example, in case of an insulation member that is not provided on any of surfaces of the first terminal 400 and the second terminal 500, a part of the insulation member could protrude above a surface of the first terminal 400.

Therefore, according to the coaxial connector of the above-described embodiment, it is possible to switch among a plurality of terminals while having a configuration that can attain high productivity and low manufacturing cost. In addition, there is no limitation in a rotational angle upon insertion/attachment and the operability is enhanced. Moreover, by application of an insulating film (resist), the production efficiency can be improved. In addition, when an insulating film is applied, it is extremely efficient for a configuration having strict limitation in a height direction. Furthermore, the space is shielded with the insulation member, so that dust can hardly enter.

In the above description, the present invention made by the inventors is explained in detail based on the embodiments, but it should be understood that the present invention shall not be limited to those embodiments, and needless to say, can be varied, altered, or modified within scope of the present invention. Furthermore, it is also possible to suitably combine a part of the plurality of embodiments.

The coaxial connector having a switch according to the present invention can be applied in a wide variety of industrial areas including information communication device industries, such as cellular phones, smartphones, and tablet-type personal computers.

The disclosure of Japanese Patent Application No. 2012-109173 filed on May 11, 2012, is incorporated in the application by reference.

While the invention has been explained with reference to the specific embodiments of the invention, the explanation is illustrative and the invention is limited only by the appended claims.

What is claimed is:

1. A coaxial connector to be connected to a first coaxial plug or a second coaxial plug, comprising:

an insulation housing having a receptacle opening portion for receiving a first central conductive member of the first coaxial plug or a second central conductive member of the second coaxial plug;

an outer conductive member disposed outside the insulation housing for detachably attaching a first outer conductive member of the first coaxial plug or a second outer conductive member;

a first terminal disposed below the receptacle opening portion;

a second terminal disposed below the first terminal and capable of being elastically deformed downwardly when the insulation housing receives the first central conductive member or the second central conductive member; and an insulation member disposed between the first terminal and the second terminal, wherein said first terminal includes a first contact portion on an upper surface thereof for contacting with an outer extended portion of the first central conductive member having a radius greater than that of the second central conductive member when the first coaxial plug is inserted into the insulation housing, said second terminal includes a second contact portion on an upper surface thereof for contacting with the second central conductive member when the second coaxial plug is inserted into the insulation housing, said first terminal further includes a third contact portion on a lower surface thereof, and said second terminal further includes a fourth contact portion on an upper surface thereof for contacting with the third contact portion when any of the first coaxial plug and the second coaxial plug is not inserted into the insulation housing.

2. The coaxial connector according to claim 1, wherein said insulation member is arranged to not contact with the second central conductive member when the second coaxial plug is inserted into the insulation housing.

3. The coaxial connector according to claim 1, wherein said insulation member is arranged to contact with the second central conductive member when the second coaxial plug is inserted into the insulation housing.

4. The coaxial connector according to claim 1, wherein said insulation member is formed of an insulation film coated on at least one of the first terminal and the second terminal.

5. The coaxial connector according to claim 1, wherein said insulation member is integrated with at least one of the first terminal and the second terminal.

6. A coaxial connector to be connected to a first coaxial plug or a second coaxial plug, comprising:

an insulation housing having a receptacle opening portion for receiving a first central conductive member of the first coaxial plug or a second central conductive member of the second coaxial plug;

an outer conductive member disposed outside the insulation housing for detachably attaching a first outer conductive member of the first coaxial plug or a second outer conductive member of the second coaxial plug;

a first terminal disposed below the receptacle opening portion;

a second terminal disposed below the first terminal and capable of being elastically deformed downwardly when the insulation housing receives the first central conductive member or the second central conductive member; and an insulation member disposed between the first terminal and the second terminal, wherein said first terminal includes a first contact portion on an upper surface thereof for contacting with an outer extended portion of the first central conductive member having a radius greater than that of the second central conductive member when the first coaxial plug is inserted into the insulation housing, said second terminal includes a second contact portion on an upper surface thereof for contacting with the second central conductive member when the second coaxial plug is inserted into the insulation housing, said first terminal further includes a third contact portion on a lower surface thereof, said second terminal further includes a fourth contact portion on an upper surface thereof for contacting with the third contact portion so that the second terminal is electrically connected to the first terminal when any of the first coaxial plug and the second coaxial plug is not inserted into the insulation housing, said second terminal is configured to be elastically deformed downwardly to separate the fourth contact portion from the third contact portion so that the second terminal is electrically disconnected from the first terminal and the first terminal is electrically connected to the first central conductive member when the first coaxial plug is inserted into the insulation housing so that the first contact portion contacts with the outer extended portion and the second terminal is pushed downwardly through the insulation member, and said second terminal is configured to be elastically deformed downwardly to separate the fourth contact portion from the third contact portion so that the second terminal is electrically disconnected from the first terminal and the second terminal is electrically connected to the second central conductive member when the second coaxial plug is inserted into the insulation housing and the second contact portion contacts with the second central conductive member to push the second terminal downwardly.

7. A coaxial connector assembly comprising:

at least one of a first coaxial plug and a second coaxial plug, said first coaxial plug including a first central conductive member, said second coaxial plug including a second central conductive member, said first central conductive member including an outer extended portion having a radius greater than that of the second central conductive member;

an insulation housing having a receptacle opening portion for receiving the first central conductive member of the first coaxial plug or the second central conductive member of the second coaxial plug;

an outer conductive member disposed outside the insulation housing for detachably attaching a first outer conductive member of the first coaxial plug or a second outer conductive member of the second coaxial plug;

a first terminal disposed below the receptacle opening portion; and a second terminal disposed below the first terminal and capable of being elastically deformed downwardly when the insulation housing receives the first central conductive member or the second central conductive member, wherein said first terminal includes a first contact portion on an upper surface thereof for contacting with the outer extended portion of the first central conductive member when the first coaxial plug is inserted into the insulation housing, said second terminal includes a second contact portion on an upper surface thereof for contacting with the second central conductive member when the second coaxial plug is inserted into the insulation housing, said first terminal further includes a third contact portion on a lower surface thereof, said second terminal further includes a fourth contact portion on an upper surface thereof for contacting with the third contact portion so that the second terminal is electrically connected to the first terminal when any of the first coaxial plug and the second coaxial plug is not inserted into the insulation housing, said second terminal is configured to be elastically deformed downwardly to separate the fourth contact portion from the third contact portion so that the second terminal is electrically disconnected from the first terminal and the first terminal is electrically connected to the first central conductive member when the first coaxial plug is inserted into the insulation housing so that the first contact portion contacts with the outer extended portion and the second terminal is pushed downwardly through an insulation member disposed on the first central conductive member, and said second terminal is configured to be elastically deformed downwardly to separate the fourth contact portion from the third contact portion so that the second terminal is electrically disconnected from the first terminal and the second terminal is electrically connected to the second central conductive member when the second coaxial plug is inserted into the insulation housing and the second contact portion contacts with the second central conductive member to push the second terminal downwardly.

8. The coaxial connector assembly according to claim 7, wherein said at least one of the first coaxial plug and the second coaxial plug further includes a protrusion.

* * * * *